United States Patent [19]

Faller et al.

[11] Patent Number: 4,625,673

[45] Date of Patent: Dec. 2, 1986

[54] MOTION COMPENSATION MEANS FOR A FLOATING PRODUCTION SYSTEM

[75] Inventors: Frank R. Faller, Vancouver; Ross G. Clouston, Richmond; Larry Bergholz, N. Delta, all of Canada

[73] Assignee: Novacorp International Consulting Ltd., Canada

[21] Appl. No.: 619,735

[22] Filed: Jun. 12, 1984

[30] Foreign Application Priority Data

Feb. 13, 1984 [CA] Canada ..... 447301

[51] Int. Cl.[4] ..... B63B 21/50

[52] U.S. Cl. ..... 114/230; 441/3

[58] Field of Search ..... 212/190; 441/3–5; 114/230, 373; 414/745; 175/7; 166/354, 355

[56] References Cited

U.S. PATENT DOCUMENTS

| | | | |
|---|---|---|---|
| 1,398,702 | 11/1921 | Maggi | 114/373 |
| 3,605,668 | 9/1971 | Morgan | 441/3 |
| 3,895,677 | 7/1975 | Bokenkamp | 175/85 |
| 3,918,379 | 11/1975 | McNary et al. | 175/27 |
| 3,919,958 | 11/1975 | Graham et al. | 175/5 |
| 3,939,991 | 2/1976 | Person | 294/90 |
| 4,029,039 | 6/1977 | van Heijst | 114/230 |
| 4,088,089 | 5/1978 | Flory | 114/230 |
| 4,128,229 | 12/1978 | Elliston | 254/139 |
| 4,176,722 | 12/1979 | Wetmore et al. | 175/7 |

FOREIGN PATENT DOCUMENTS

| | | | |
|---|---|---|---|
| 2411755 | 8/1979 | France | 114/230 |
| 1574530 | 9/1980 | United Kingdom . | |
| 2141470 | 12/1984 | United Kingdom . | |

OTHER PUBLICATIONS

"Gravity-Base SALS at Tazerka" from Offshore Europe.

"Tanker Production Eyed for Deep, Rough Seas" in Offshore, Mar. 1983.

*Primary Examiner*—Sherman D. Basinger

*Attorney, Agent, or Firm*—Stevens, Davis, Miller & Mosher

[57] ABSTRACT

There is disclosed an apparatus for providing passive motion compensation at the ship-riser interface of a rise-moored floating production system or oil storage tanker, with its associated equipment including a riser handling system. Normal production proceeds, while ship motions are isolated from the riser, preventing excessive load transfer or unacceptable dyanmic effects. The main feature of the system is its ship-borne installation, with all moving parts clear of the waterline. The system is totally self-contained, with motion compensation, riser pipe and handling equipment on board. By installing the flotation within the hull of the ship, it moves with the ship, thus avoiding significant inertial and weather-related loads. The design is flexible. The range of seas can be extended by adjusting the basic parameters: float shape and size, tank depth, liquid S.G., counterweight size, link geometry, bridge length, etc.

4 Claims, 11 Drawing Figures

MOTION COMPENSATION MEANS FOR A FLOATING PRODUCTION SYSTEM

FIELD OF THE INVENTION

This invention pertains to hydrocarbon production from offshore oil fields to a floating, ship-shape production or storage facility. In particular, it relates to the methods and apparatus required to isolate ship motions from the mooring tether or riser and provides features which facilitate ease of operation.

BACKGROUND OF THE INVENTION

Existing tanker-based floating production systems evolved from tanker mooring terminals. After initial successes with these simple systems, more sophisticated types were developed to broaden the operational capabilities. For the purpose of putting the present invention into perspective, there are two fundamentally different types of systems. The difference is in the tanker mooring method and in the riser which connects the wellheads on the seabed to the tanker.

One type of floating production mooring system consists of a buoy anchored to the seabed by a conventional catenary mooring spread. The tanker is attached to the buoy by a hauser and is free to swing around the buoy as the sea conditions change. The risers with this system are flexible hoses.

The other type of floating production mooring uses a single anchor leg or tower instead of a catenary moor, and a rigid link or yoke connecting the tanker to the tower. Again the tanker is free to weathervane around the tower. In this case the tower acts as the riser as well as the mooring device. The yoke has hinges which allow the tanker to move freely, without pulling or compressing the tower.

The present invention relates more to the single anchor leg, but a knowledge of the differences in the loading of the mooring system will help in the understanding of the invention. One difference between catenary moor and the single tower is that a catenary anchor line only acts in one direction, so many lines are required for multidirectional load capability. But the main difference is in the anchoring at the seabed. The tower, being rigid, puts a high vertical load into the seabed whereas the catenary moor relies on heavy chain weight and puts a horizontal load into the seabed.

But at the surface, the principle is the same for both systems. The restraining force is provided by the horizontal component of the tension in the anchor line or tower.

Dealing now only with the tower, the tension is provided by buoyancy, either in the top of the tower or in the yoke connection to the tanker this is the basis of the "SALS" system.

The tower system is designed to suit the water depth and sea conditions of a specific site. Thus, to move the tower to a different location would require modifications to suit the new water depth. The system is also permanent in that the release of the tanker requires a significant decommissioning operation. Similarly, the buoyant yoke assembly, although attached to the tanker by hinges, becomes a permanent part of the tanker, making it difficult for the tanker to move location in bad sea conditions. When considering deep water, the tower system has operational limitations. Because the system relies on the tower being at an angle to provide tanker restraint, i.e. a horizontal component of tension, the top of the tower swings downward as the angle of the tower increases. This vertical displacement is proportional to water depth. In deep water the yoke either requires greater movement or the buoyancy force must be increased to reduce the angular requirements of the tower. Either way, the whole system becomes larger, reducing its practical and economic viability.

Catenary anchor systems. although slightly less permanent than tower/yoke systems, have similar limitations. Movements and chain sizes become impractical in severe sea conditions and deep water.

The yoke is common to most of the larger facilities. It is coupled to the ship with hinges, on its beam girth line. The yoke is necessarily large for the following reasons:

Its length provides heave and pitch freedom and its width must be such to allow direct mounting to the bow or stern of the ship at its girth line;

It is heavy so as to be structually capable of handling very large tensile, compressive, and torsional loads due to mooring and wave action.

In all cases, the yoke only has freedom to hinge up and down. Whenever the ship rolls, the structure must follow the ship, hence loading the hinge pins and twisting the relatively long yoke about the riser/tower/buoy connection. This is a serious load problem. Sway also "drags" the entire yoke to the side further complicating the force combination at the hinges.

Suffice to say that the yokes are extremely robust and correspondingly heavy. Even the smallest ones, used in quite moderate sea conditions, weigh 500–600 tons. The best known unit, TAZERKA, has a yoke weight of over 2000 tons.

Buoy systems "disappear" on crossing the 500 ft. depth boundary. Towers with associated yokes also lose favour at 600 ft. depth. The reasons are that the deeper water means more chain length for the buoy: it gets bigger, catches more wave loading and ruins the yoke-buoy connection. For towers, towing it out horizontally and uprighting it is critical: too much bad treatment and it bends.

For the "SALM" systems, which introduce an articulation at the centre of the tower, there is an improvement. However, a system has not yet been installed in deep water.

The "SALS" system tends to stand out on its own, but again, it is presently bounded by the "tower" weakness which also limits the system to a specific, shallow water site.

One thing common to all these known yoke systems, is that the riser/swivel/manifold unit is remote. That means access problems to the riser itself. All these systems impose limitations on themselves, especially their access features, by answering only the strictly functional, mooring, problems. To say nothing of deployment.

The features of the present invention attempt to address as many of the functional and operational aspects as possible, most benefits being realized from the unique motion compensation arrangement.

The objective of the present invention is to overcome the above mentioned limitations of the art and to provide a tanker-based floating production system that is very mobile and relatively insensitive to water depth, featuring an inexpensive, passive motion compensation system.

This objective is achieved in part by having a riser that is made up from 50-ft. sections and deployed from the production tanker. The riser is lowered from the tanker as it is made up, locked to a riser base on the seabed, and tensioned by an internal float motion compensator on the tanker. The tanker is then allowed to move away from its original position under the action of wind, waves and current until the riser is at a sufficient angle to stop further tanker movement. As in the tower and yoke systems, the horizontal component of the riser tension provides the restraining force on the tanker.

Flotation provides substantial forces, which are considered "free". Hydraulics will do the same, but with unwanted complexity and expense.

Floats in the sea beside a ship pick up waveinduced forces. If they are attached to push rods, levers, cage structures or other devices, they invariably have to move around in the water, inducing high loads in the linkages, etc. Basically, having floats attached to the ship, external to the hull, is not an intelligent way of finding free forces for mooring. Whenever the ship rolls, for example, so must the float, often at its worst extension. This causes problems of friction, roll amplification, unwanted structural loads, etc.

The SALS system is a prime example of a float external to the ship, which must be held in a massive structure just to survive its demanding environment.

All the buoy mooring systems have the same problem, as mentioned previously. As depths and sea states get more demanding, the buoyancy must be increased. However, a definite limit is reached; if this limit is ignored, the only way to make the system work is to make structures, floats and bearings very large, clumsy and expensive.

By putting float devices within the ship in accordance with the present invention some clear advantages are observed:

not influenced by wave induced forces, or splash zone pounding;

floats roll, pitch, yaw, sway and surge with the ship;

it is a controlled environment with good access;

operators can observe and monitor float behaviour, conditions;

buoyancy can be controlled directly using compressed air to de-ballast the floats;

the S.G. of the surrounding medium can be altered to derive optimum buoyancy, viscosity;

travel of the float or heave is a fraction of the ship's heave;

float accelerations and velocities (heave) are also a fraction of the ship's values;

float shapes can be more innovative due to the better defined operating environment;

the float is totally self-contained within the ship and needs no deployment steps whatsoever; and the float can be used to provide base forces during riser deployment.

BRIEF DESCRIPTION OF THE DRAWINGS

The invention is illustrated in the accompanying drawings in which:

As shown in FIG. 3, a floating production system is connected to a subsea riser base anchor 1 by a tension riser 2, the upper termination of which is a multiple pass swivel 3, the lower terminal end of the riser being a connector assembly 4 which mates with a conical riser base termination 5. The swivel 3 is mounted in a gimballed spider 6 which in turn is held in a framework that forms the fore end of the trussed bridge structure 7. The bridge 7 is pivoted at its aft end by a deck-mounted hinge bearing 8. The entire bridge is constrained laterally by two vertical stanchions 9 which consist of two columns and associated lateral bracing. As the ship heaves up and down, these stanchions remove lateral loading near the gimbal. The bridge sides carry bearing pads with roller quides 10 which reduce friction as the bridge moves relative to the stanchions the vertical posts and associated side bracing that straddle the sides of the forebridge extend upwards to a sufficient height to cover the vertical motion of the bridge. These posts absorb lateral forces which arise from mooring upsets; no lateral forces are transmitted into the bridge and hence its modest structure. Whenever the ship takes an upset angle of instance to the weather, it is forced to return-weather vaning perfectly from the bow. A roller carriage on each side of the bridge engages the posts providing an easy-running mechanism. The pin on the aft bridge is loaded in one plane only (tension induced shear) with no torsion or lateral bending permitted.

Taking the gimbal 6 as the "fixed point" it will be appreciated that the ship is free to heave, pitch, roll, yaw, surge and sway by virtue of the following uncoupling mechanisms:

the gimbal 6 which uncouples roll, sway, surge and basic pitch;

the float and bridge which uncouples heave and implied pitch heave; and the swivel 3 which uncouples yaw.

Figure 1:
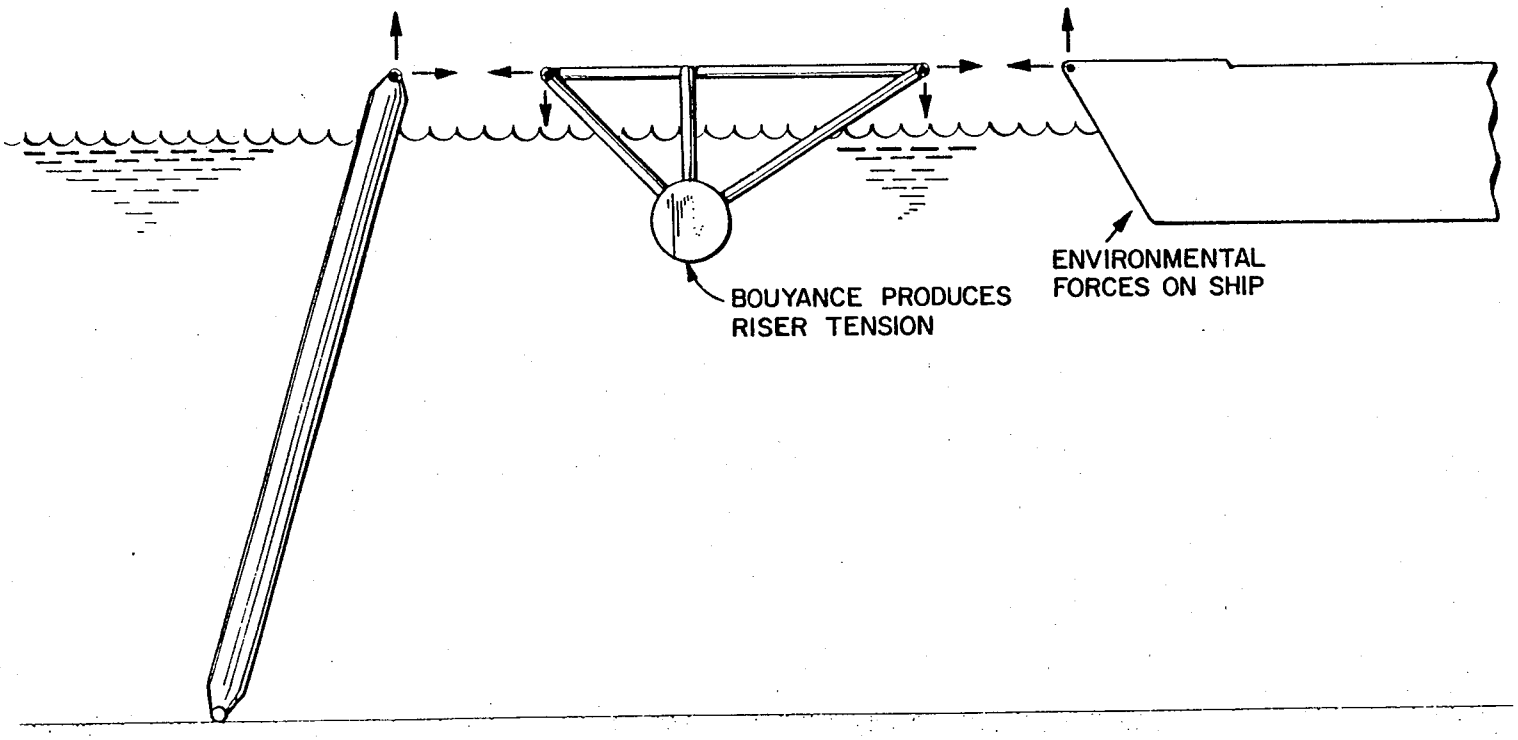
FIGS. 1 through 2*d* are schematic views of a SALS system showing forces thereon and yoke movement.
Figure 2A:
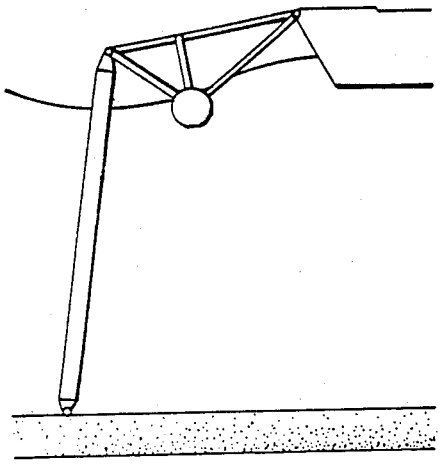
Figure 2B:
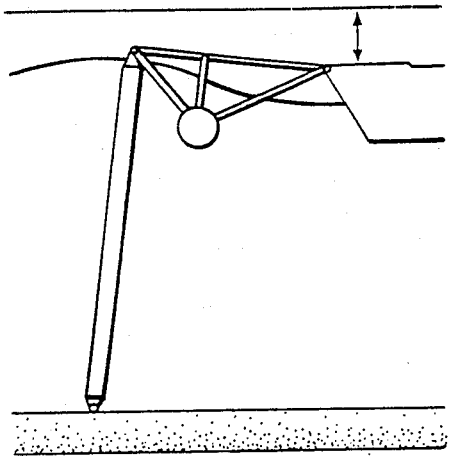
Figure 2C:
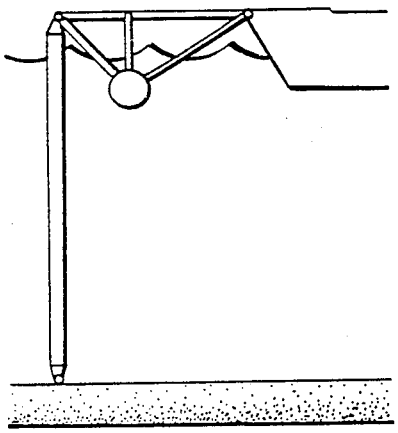
Figure 2D:
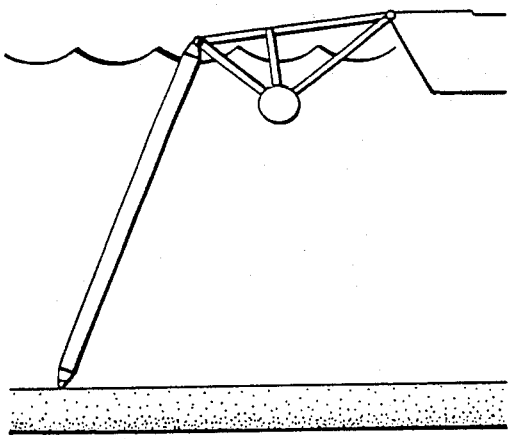
Figure 3:
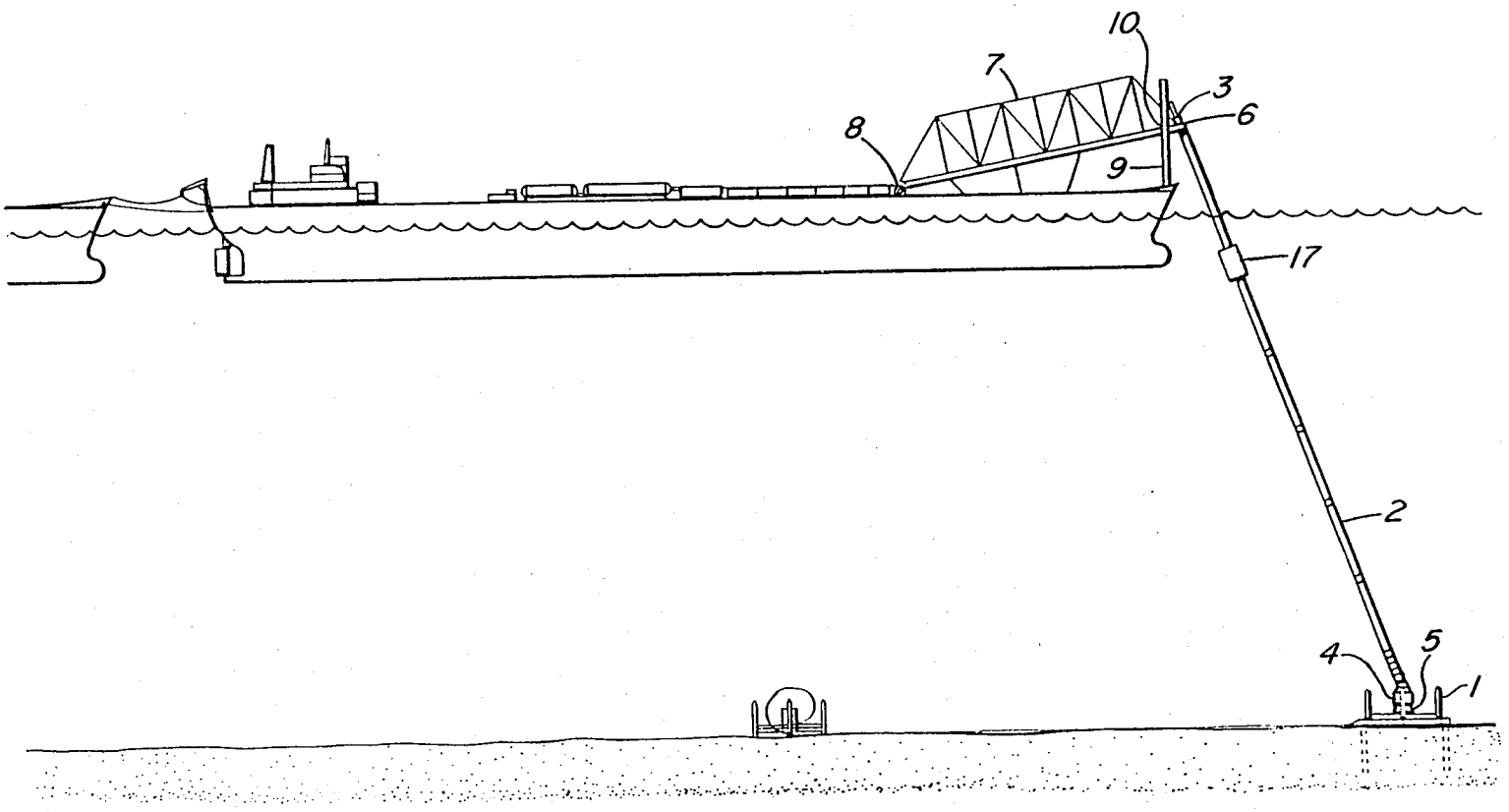
FIG. 3 illustrates a floating production system connected to a subsea riser base anchor.
Figure 4A:
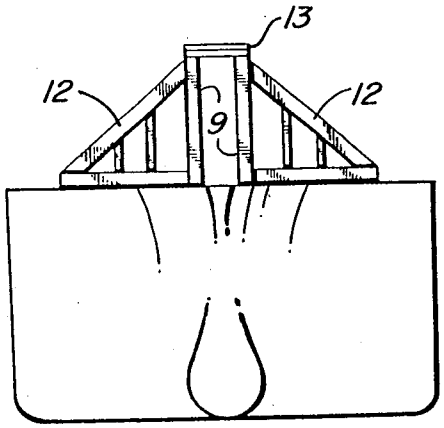
FIG. 4*a* is a bow-end elevation view of the invention in a bow mounted version.

The bridge 7 is of light weight, transparent structure consisting of a double sided truss with cross bracing to complete a box section. The bridge 7 can be set at any desired angle of inclination by de-ballasting the floats 11 (FIGS. 4 and 5) and to provide a heave compensation ability on initial riser deployment, twin hydraulic cylinders or compensating rams 23 are latched to the truss sides as shown in FIG. 5.

Figure 4B:
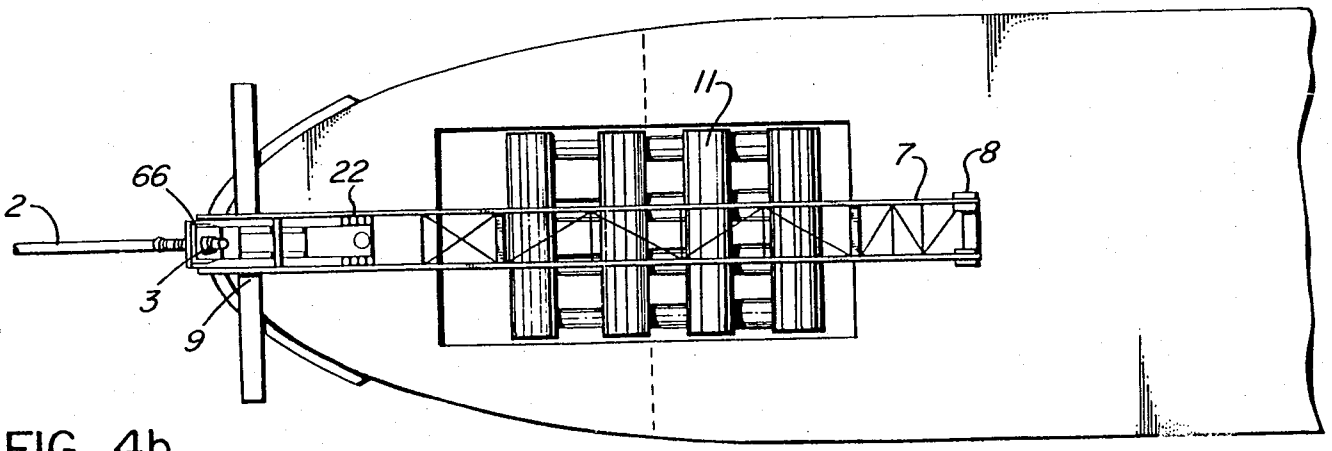
FIG. 4*b* is a plan view of the bow of the craft shown in FIG. 3.

FIG. 4*b* shows the location of the internal floats 11 which are directly below the two sides of the bridge structure 7. The top of the riser 2 and swivel 3 are seen emerging from the gimbal 6, the stanchions 9, lateral braces 12 and top cross head 13 are also illustrated.

The floats 11 are separated to reduce drag, viscous effects and added virtual mass inertia while kept low in profile to achieve maximum vertical traverse. The floats 11 are necessarily large to meet the buoyance requirement. By mounting the floats 11 to the bridge 7 with rigid links 14, the structural rigidity and dimensions of the truss are optimized. Full buoyancy of the floats 11 is approximately $5.5\times10^6$ pounds which, though high, is several orders less than the SALS system for example.

Figure 5:
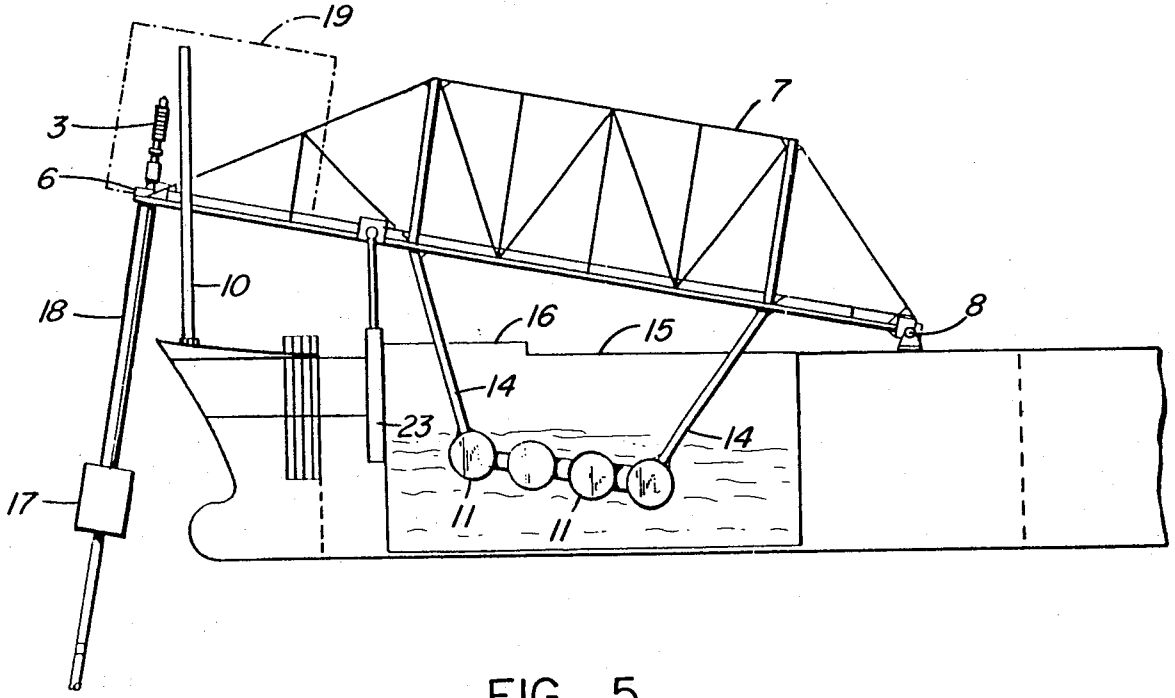
FIG. 5 is an elevation view of the bow section shown in FIGS. 4*a* and 4*b;*

FIG. 5 is a cut away drawing to reveal the array of internal floats 11. In practice, an integrated matrix array of four longitudinal and four transverse floats, fully interlocked, would be used for the high sea state buoyancy requirements. Furthermore, the aft float depths would be greater than the four cylinders, hence producing a wedge-shaped array. The floats 11 are rigidly fixed to the bridge 7 by links 14 which are straight but may be curved suitably to acheive minimal tank cover 15 penetration. A riser abandonment float 17 forms the lower end of a reinforced upper riser section 18 which allows the ship to uncouple from the riser is conditions come about which places the ship/riser in jeopardy. In FIG. 5 reference numeral 19 indicates a riser handling system. The active heave compensation rams 23 are shown in an extended position.

Figure 6:
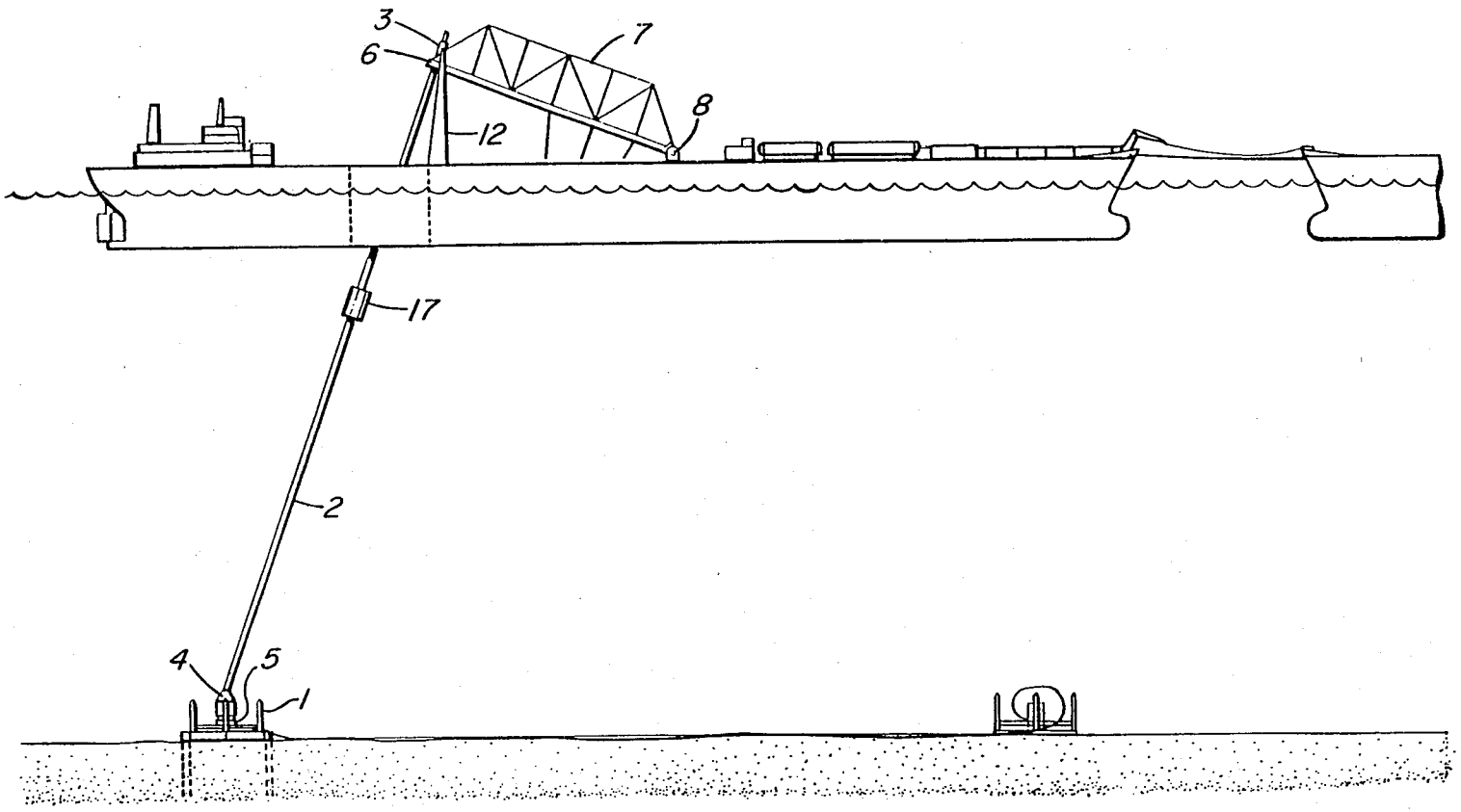
FIG. 6 is an elevation view of another embodiment of the invention.
Figure 7:
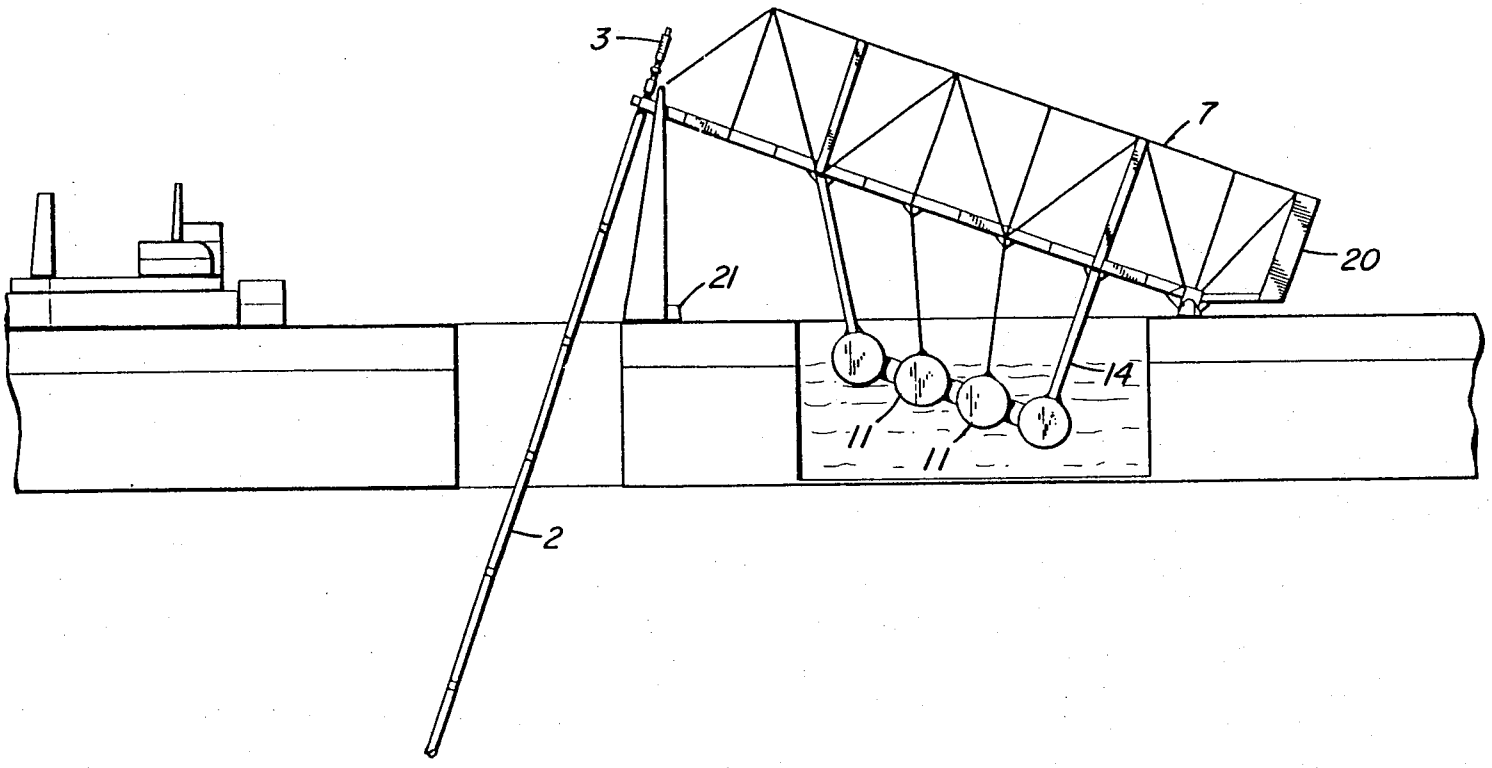
FIG. 7 is an elevation view of a section of the craft shown in FIG. 6.

FIGS. 6 and 7 illustrate a moon-pool version of the invention.

FIG. 7 shows a counter weight 20 which helps to balance the dead weight of the entire bridge/float assembly and permits a slight reduction of actual float size. Bridge stops 21 are shown, these preventing the assembly from slapping the deck plating in transit and providing a sea-lock mechanism. They also ensure that the bridge cannot depress the float beyond the ship tank bottom.

Additional features of the invention listed below will be appreciated.

The riser base could be deployed and set on the sea bed from the tanker (assuming lightweight base which is ballasted by pumped concrete from the surface). Pile or suction anchor devices are also feasible.

A moonpool version of the system as shown in FIG. 6 is feasible for ice-infested waters. The only significant variation is the ship modification necessary in a moonpool design.

A counterweight which helps to balance out the bridge/float/riser/lifter weights is used if water depths exceeding 800 ft. are expected as seen in FIG. 7. Adding moment arm aft of the pivot permits the float sizes to be reduced slightly for a given sea state. Too much weight incurs a penalty of inertia, so a compromise is used.

Curved struts linking the floats to the bridge structure would ensure minimal tank cover penetration and splash effects. Simple cuff seals, rubber, contain the liquid.

Variable geometry linkages between floats and bridge, where the ends are pin-jointed and an inclined or curved track displaces the float array forward or aft to counteract remaining force variation due to float added mass and drag.

In the situation where abandonment of the riser is necessary, the upper riser section includes an abandonment float. The riser, float and upper protective cage structure will separate and the riser will self-right to the vertical. The riser is fully tensioned; the small water plane area and reinforced upper section would ensure survival. The vessel can abandon safely. Reconnection is straight forward since the riser upper attachment point is above the surface.

While the invention has been described in connection with a specific embodiment thereof and in a specific use, various modifications thereof will occur to those skilled in the art without departing from the spirit and the scope of the invention as set forth in the attached claims.

The terms and expressions which have been employed in the specification are used as terms of description and not of limitation and there is no intention in the use of such terms and expressions to exclude any equivalence of the features shown and described or portions thereof, but it is recognized that various modifications are possible within the scope of the invention claimed.

The embodiments of the invention in which an exclusive property or privilege is claimed are defined as follows:

1. A self-contained system for providing passive motion compensation at a ship-riser interface of a riser-moored floating production system or oil storage tanker, said system comprising:

a ship having a flooded foretank;

a trussed bridge structure mounted on the deck of said ship, said bridge structure being pivotally mounted to said deck at the aft end of the bridge structure and well inward of the bow end of said ship and having its fore end overhanging the bow of said ship;

said flooded foretank being located between the pivoted end of the bridge and the bow end of the ship;

a riser attached to the fore end of the bridge structure; stanchion means straddling the sides of the fore end of the bridge structure and being of sufficient height to include the vertical motion of the bridge structure;

float means rigidly secured to and suspended below said bridge structure and positioned within said flooded foretank of said ship for exerting an upward bouyant force on the bridge structure; and a production line swivel in a gimbal mounted on the fore end of the bridge structure for connection to a production riser.

2. A system according to claim 1 wherein said float means comprises individual, interconnected float tanks connected to the underside of the bridge structure by link arms.

3. A system according to claim 2 wherein the depth of the aftermost float in the tank of the ship is greater than the fore end floats thereby producing a wedge-shaped array.

4. A system according to claim 1 including a counterweight on said bridge structure aft of the pivot point thereof.

* * * * *